US007629752B2

(12) United States Patent
Mi et al.

(10) Patent No.: US 7,629,752 B2
(45) Date of Patent: Dec. 8, 2009

(54) LIGHT SOURCE DRIVING DEVICE

(75) Inventors: Tzu-Chiang Mi, Taipei Hsien (TW); Chih-Chan Ger, Taipei Hsien (TW); Wen-Lin Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/061,665

(22) Filed: Apr. 3, 2008

(65) Prior Publication Data

US 2008/0246420 A1 Oct. 9, 2008

(30) Foreign Application Priority Data

Apr. 6, 2007 (CN) ..... 2007 1 0200407

(51) Int. Cl.
*H05B 37/02* (2006.01)

(52) U.S. Cl. ..... 315/224; 315/219; 315/247; 315/291

(58) Field of Classification Search ..... 315/224, 315/226, 247, 276, 291, 307–308, 312, 209 R, 315/212, 219, 225
See application file for complete search history.

(56) References Cited

U.S. PATENT DOCUMENTS 6,326,740 B1 * 12/2001 Chang et al. ..... 315/291
7,176,637 B2 * 2/2007 Inoue et al. ..... 315/291
7,285,919 B2 * 10/2007 Newman et al. ..... 315/224
7,425,802 B2 * 9/2008 Kumagai et al. ..... 315/291
2002/0012367 A1 * 1/2002 Niu et al. ..... 372/30
2008/0272706 A1 * 11/2008 Kwon et al. ..... 315/219

FOREIGN PATENT DOCUMENTS

CN 1298625 A 6/2001
TW 417409 1/2001

* cited by examiner

*Primary Examiner*—David Hung Vu
*Assistant Examiner*—Tung X Le
(74) *Attorney, Agent, or Firm*—Frank R. Niranjan

(57) ABSTRACT

A light source driving device is for driving a plurality of light sources of a light source module (12), and comprises an inverter circuit (11), a current sampling circuit (13) and a PWM controller (14). The inverter circuit converts a received DC signal to an electrical signal adapted for driving the light sources. The current sampling circuit for sampling current flowing through the inverter circuit, comprises an impedance detecting component ($Z_{11}$) and an amplifying circuit (132), the impedance detecting component detects the current from the inverter circuit, the amplifying circuit is connected to the impedance detecting component for amplifying the current signal. The PWM controller is connected to the current sampling circuit for receiving the amplified current signal output from the current sampling circuit, and generating a control signal to the inverter circuit to control output thereof.

22 Claims, 3 Drawing Sheets

LIGHT SOURCE DRIVING DEVICE

BACKGROUND

1. Field of the Invention

The invention relates to light source driving devices, and particularly to a light source driving device used in liquid crystal display (LCD) backlight module.

2. Description of Related Art

Conventionally, discharge lamps, especially Cold Cathode Fluorescent Light sources (CCFLs) are often used as light sources in LCD panels. Typically, the light sources need high voltages to operate. Recently, LCD panels have become larger and larger, and as a result, the number of light sources needed in the LCD panels has increased.

FIG. 3 is a conventional light source driving device. The driving device is used for driving a light source module 32 comprising a plurality of light sources, which comprises a driving switch circuit 30, a transformer circuit 31, a feedback circuit 33 and a Pulse Width Modulation (PWM) controller 34. The driving switch circuit 30 converts a received direct current (DC) signal to an alternating current (AC) signal. The transformer circuit 31 converts the AC signal to a sine-wave signal to drive the light source module 32. The feedback circuit is connected between the transformer circuit 31 and the PWM controller 34, for feeding current flowing through the light source module 32 back to the PWM controller 34. The PWM controller 34 controls the AC signal output from the driving switch circuit 30 according to the current flowing through the feedback circuit 33. Thus, the current from the light source module 32 can be controlled.

In the above conventional discharge lamp driving device, the feedback signal from the transformer circuit 31 not only includes lamp current, but leakage current as well, which comes from stray capacitances between the light sources and ground. Obviously, the leakage current affects the accuracy of the feedback signal.

SUMMARY

One aspect of the invention provides a light source driving device. The light source driving device is for driving a plurality of light sources of a light source module, and comprises an inverter circuit, a current sampling circuit, and a PWM controller. The inverter circuit, is for converting a received DC signal to an electrical signal adapted for driving the light sources. The current sampling circuit is for sampling current flowing through the inverter circuit. The current sampling circuit comprises an impedance detecting component, for detecting current from the inverter circuit, and an amplifying circuit connected to the impedance detecting component for amplifying the current signal. The PWM controller is connected to the current sampling circuit for receiving the amplified current signal output from the current sampling circuit, and generating a control signal to the inverter circuit to control output thereof.

Other advantages and novel features will become more apparent from the following detailed description when taken in conjunction with the accompanying drawings, in which:

DETAILED DESCRIPTION OF THE EMBODIMENTS

Figure 1:
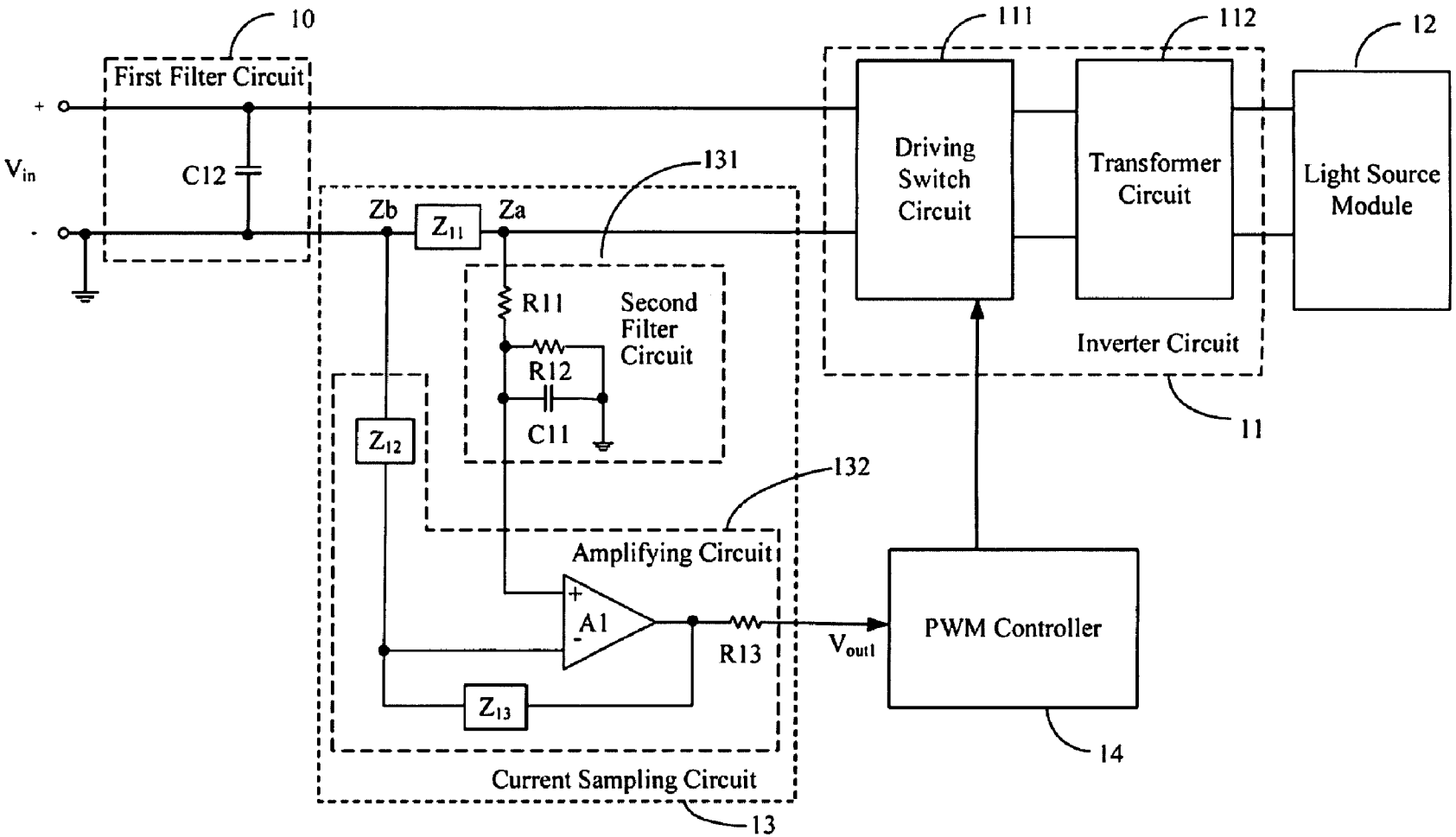
FIG. 1 is a function block diagram of a light source driving device in accordance with an exemplary embodiment of the invention.

FIG. 1 is a function block diagram of a light source driving device in accordance with an exemplary embodiment of the invention. The light source driving device is connected to a DC power source (not shown), for converting a DC signal $V_{in}$ provided by the DC power source to an electrical signal to drive a plurality of light sources of a light source module 12. In the exemplary embodiment, the DC power source has a high voltage end and a low voltage end, for providing the DC signal $V_{in}$. The light source driving device comprises a first filter circuit 10, an inverter circuit 11, a current sampling circuit 13, and a Pulse Width Modulation (PWM) controller 14.

In the exemplary embodiment, the DC power source can be a DC/DC converter or an AC/DC converter.

The first filter circuit 10 is connected between the high voltage end and the low voltage end of the DC power source for filtering noise existing in the DC signal $V_{in}$. In the exemplary embodiment, the first filter circuit 10 comprises a capacitor C12.

The inverter circuit 11 is connected in parallel to the first filter circuit 10, for converting the DC signal $V_{in}$ to an electrical signal adapted for driving the light sources. In the exemplary embodiment, the inverter circuit 11 comprises a driving switch circuit 111 and a transformer circuit 112. The driving switch circuit 111 converts the DC signal $V_{in}$ to an AC signal. The transformer circuit 112 is connected to the driving switch circuit 111, for converting the AC signal to the electrical signal to drive the light source module 12. In the exemplary embodiment, the DC signal $V_{in}$ input to the inverter circuit 11 is without noise. The AC signal output from the driving switch circuit 111 is a square-wave signal, and the electrical signal output from the transformer circuit 112 is a sine-wave signal.

The current sampling circuit 13 is connected between the first filter circuit 10 and the inverter circuit 11, for sampling current flowing through the inverter circuit 11. In the exemplary embodiment, the current sampling circuit 13 comprises a second filter circuit 131, an impedance detecting component $Z_{11}$, and an amplifying circuit 132. The second filter circuit 131 comprises a first resistor R11, a second resistor R12, and a first capacitor C11. The amplifying circuit 132 comprises an amplifier A1, a first impedance component $Z_{12}$, a second impedance component $Z_{13}$ and a third resistor R13.

The impedance detecting component $Z_{11}$ is connected between the first filter circuit 10 and the driving switch circuit 111 of the inverter circuit 11, for detecting current from the inverter circuit 11. In the exemplary embodiment, one end of the impedance detecting component $Z_{11}$ acts an input Za and the other end acts an output Zb. The input Za is connected to the inverter circuit 11, and the output Zb is connected to the low voltage end of the DC power source. In the exemplary embodiment, the current detected by the impedance detecting component $Z_{11}$ is an AC signal, and the impedance detecting component $Z_{11}$ is a resistor.

In other exemplary embodiments, the impedance detecting component $Z_{11}$ can also be a combination of a resistor and a capacitor connected in parallel.

The amplifying circuit 132 is connected to the output Zb of the impedance detecting component $Z_{11}$, for amplifying the current signal detected by the impedance detecting component $Z_{11}$. The amplifier A1 includes a positive electrode input, a negative electrode input, and an output. One end of the first impedance component $Z_{12}$ is connected to the negative electrode input of the amplifier A1, and the other end thereof is connected to the output Zb of the impedance detecting component $Z_{11}$. The second impedance component $Z_{13}$ is connected between the negative electrode input and the output of the amplifier A1. In the exemplary embodiment, the first impedance component $Z_{12}$ and the second impedance component $Z_{13}$ are resistors. One end of the third resistor R13 is connected to the output of the amplifier A1, and the other end thereof is defined as the output of the current sampling circuit. In other words, the other end of the third resistor R13 is connected to the PWM controller. In the exemplary embodiment, the electrical signal output from the amplifier A1 is $V_{out1}$.

The second filter circuit 131 is connected between the positive electrode input of the amplifier A1 and the input Za of the impedance detecting component $Z_{11}$, for filtering high frequency signal existing in the current signal. In detail, one end of the first resistor R11 is connected to the input Za of the impedance detecting component $Z_{11}$, and the other end thereof is connected to the positive electrode input of the amplifier A1. The first capacitor C11 is connected between the positive electrode input of the amplifier A1 and ground. The first resistor R11 and the first capacitor C11 form a low-pass filter, for filtering the high frequency parts of the current signal. The second resistor R12 is connected to the first capacitor C11 in parallel.

The PWM controller 14 is connected to the current sampling circuit 13, for receiving the electrical signal $V_{out1}$ output from the current sampling circuit 13, and generating a control signal to the inverter circuit 11 to control output thereof. In the exemplary embodiment, the PWM controller 14 is connected between the current sampling circuit 13 and the driving switch circuit 111, for controlling output of the driving switch circuit 111. In other embodiments, the PWM controller 14 may comprise a PWM integral circuit (not shown) and a feedback network (not shown). The feedback network is connected to the PWM integral circuit.

In the exemplary embodiment, the current sampling circuit 13 is connected between the first filter circuit 10 and the inverter circuit 11. The light source driving device can utilize the impedance detecting component $Z_{11}$ of the current sampling circuit 13 to detect the current signal flowing through the inverter circuit 11, and then the current signal is filtered by the second filter circuit 131 and amplified by the amplifying circuit 132. Subsequently, the PWM controller 14 receives the amplified signal, and generates a control signal to the inverter circuit 11 to control output of the inverter circuit 11, thereby controlling current flowing through the light source module 12.

Figure 2:
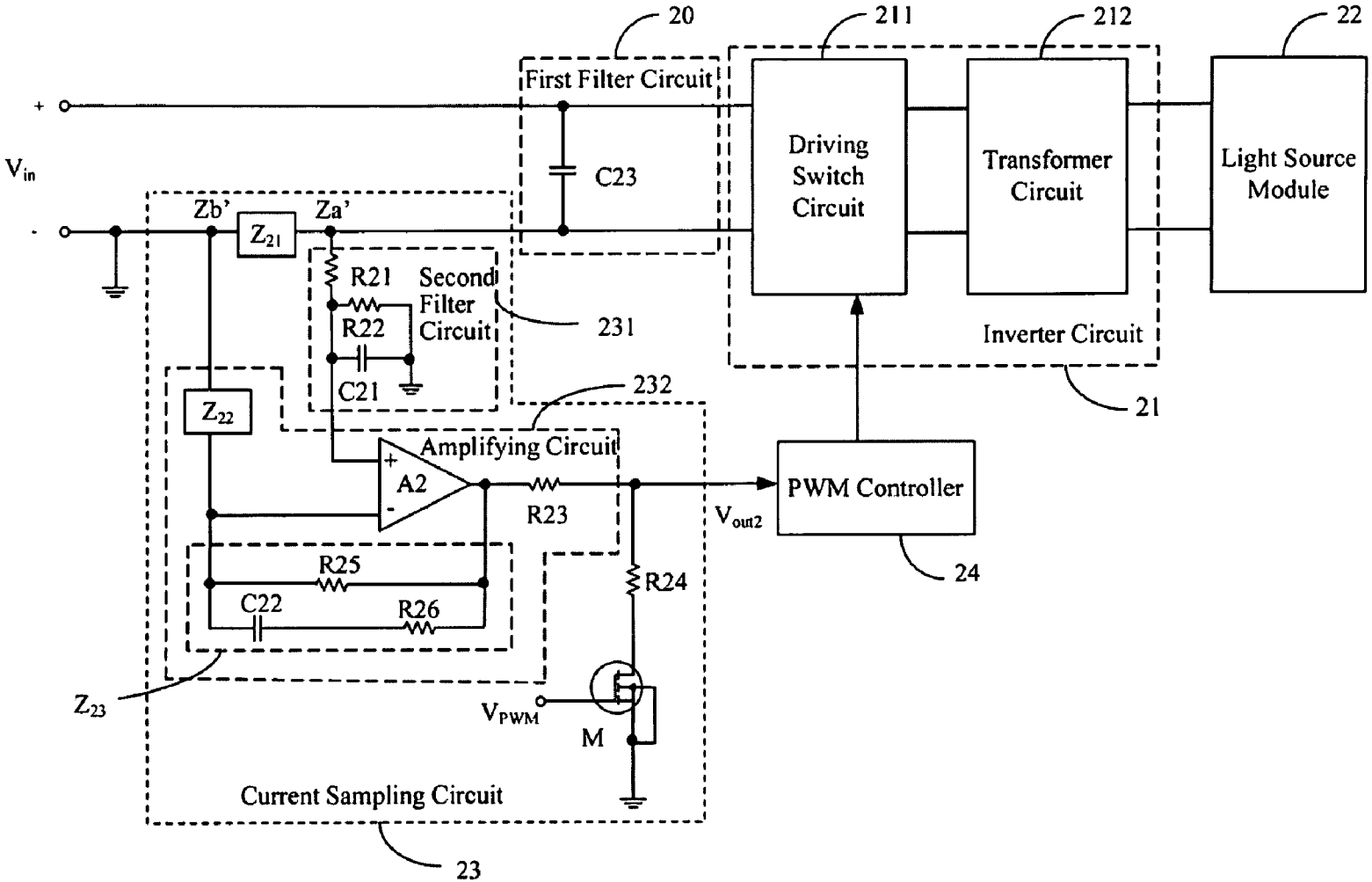
FIG. 2 is a function block diagram of a light source driving device in accordance with another exemplary embodiment of the invention.
Figure 3:
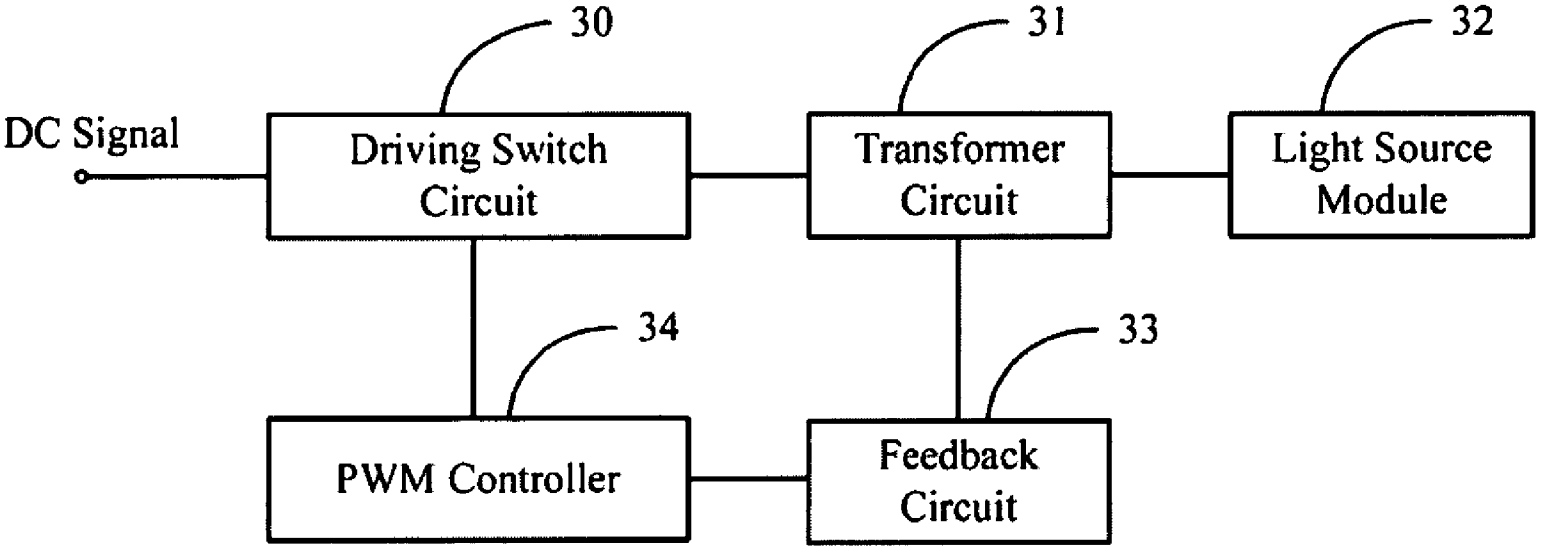
FIG. 3 (PRIOR ART)
FIG. 3 is a conventional light source driving device.

FIG. 2 is a function block diagram of a light source driving device in accordance with another exemplary embodiment of the invention, which is substantially the same as the driving device of FIG. 1, except for placement of the first filter circuit 20, and components of the current sampling circuit 23. An end of the capacitor C23 that is connected to the low voltage end of the power source Vin of the first filter circuit 20 is instead connected to the input Za of the impedance detecting component Z11, thereby the current sampling circuit 23 is connected to the end of the first filter circuit 20. In other words, the first filter circuit 20 is connected between the current sampling circuit 23 and the inverter circuit 21. Thus, the current detected by the impedance detecting component $Z_{21}$ is a DC signal, which does not flow through the first filter circuit 20.

In this exemplary embodiment, the current sampling circuit 23 further comprises a fourth resistor R24 and a switch component M. The switch component M comprises an input, a first output and a second output. The input of the switch component M receives a PWM signal $V_{pwm}$, the first output of the switch component M is connected to the PWM controller 24 by way of the fourth resistor R24, and the second output of the switch component M is grounded. The fourth resistor R24 is disposed between the first output of the switch component M and the other end of the third resistor R23.

In the exemplary embodiment, when the switch component M is on, the third resistor R23 and the fourth resistor R24 co-form a voltage dividing circuit to pull voltage of an electrical signal $V_{out2}$ output from the current sampling circuit 23 down. When the switch component M is off, the voltage of the signal $V_{out2}$ output from the current sampling circuit 23 remains high.

In the exemplary embodiment, the PWM signal $V_{pwm}$ received by the input of the switch component M can be a PWM signal output from an external controller (not shown) of the light source driving device, or from an internal PWM controller.

In the exemplary embodiment, the second impedance component $Z_{23}$ comprises a fifth resistor R25, a sixth resistor R26 and a second capacitor C22. The fifth resistor R25 is disposed between the negative electrode input and the output of the amplifier A2. The sixth resistor R26 is connected to the second capacitor C22 in series, the combination is then connected to the fifth resistor R25 in parallel. In the exemplary embodiment, the sixth resistor R26 and the second capacitor C22 form a compensation circuit, for compensating gain variation of the amplifier A2 caused by burst current when the driving switch circuit 211 is switching on or off.

In the exemplary embodiment, the current sampling circuit 23 is connected to the input of the first filter circuit 20. The light source driving device utilizes the impedance detecting component $Z_{21}$ to detect the current signal flowing through the inverter circuit 21 as a DC signal. The DC signal is filtered by the second filter circuit 231 and amplified by the amplifying circuit 232. Then, the switch component M converts the amplified DC signal to an electrical signal $V_{out2}$. The PWM controller 24 receives the electrical signal $V_{out2}$, and generates a control signal to control output of the inverter circuit 21, further to control the current of the light source 22.

In the present invention, the light source driving device utilizes the impedance detecting component $Z_{23}$ of the current sampling circuit 23 to detect current flowing through the inverter circuit 21, and the amplifying circuit 232 to amplify the current detected by the impedance detecting component $Z_{23}$. Subsequently, the PWM controller 24 receives the amplified signal, and generates a control signal to the inverter circuit 21 to control output thereof, further to control the current of the light sources. Therefore, the light driving device of the invention uses the current sampling circuit 23 to sample the current from the inverter circuit 21, which would not be affected by the electrical characteristics of the light sources. In this way, the accuracy of the current sampling circuit 23 is improved.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments.

What is claimed is:

1. A light source driving device is for driving a plurality of light sources of a light source module, comprising:

an inverter circuit, for converting a received DC signal to an electrical signal adapted for driving the light sources;

a current sampling circuit, for sampling current flowing through the inverter circuit, the current sampling circuit comprising:

an impedance detecting component, for detecting current from the inverter circuit; and an amplifying circuit, connected to the impedance detecting component for amplifying the current signal, comprising:

an amplifier, including a positive electrode input, a negative electrode input and an output;

a first impedance component, one end of thereof being connected to the negative electrode input of the amplifier, and the other end thereof being connected to one end of the impedance detecting component; and a second impedance component, connected between the negative electrode input and the output of the amplifier;

a first filter circuit connected between the positive electrode input of the amplifier and the other end of the impedance detecting component, comprising:

a first resistor, one end thereof being connected to the other end of the impedance detecting component;

a first capacitor, connected between the positive electrode input of the amplifier and ground; and a second resistor, connected to the first capacitor in parallel; and a PWM controller, connected to the current sampling circuit, for receiving the amplified current signal output from the current sampling circuit, and generating a control signal to the inverter circuit to control output thereof.

2. The light source driving device of claim 1, further comprising a second filter circuit connected to the inverter circuit.

3. The light source driving device of claim 2, wherein the current sampling circuit is disposed between the second filter circuit and the inverter circuit.

4. The light source driving device of claim 1, wherein the amplifying circuit comprises a third resistor with one end being connected to the output of the amplifier and the other end being defined as the output of the current sampling circuit.

5. The light source driving device of claim 4, wherein the current sampling circuit comprises a switch component comprising an input, a first output and a second output, wherein the input is controlled by a PWM signal, the second output is grounded.

6. The light source driving device of claim 5, further comprises a fourth resistor, disposed between the first output of the switch component and the other end of the third resistor.

7. The light source driving device of claim 1, wherein the second impedance component comprising:

a fifth resistor, disposed between the negative electrode input and output of the amplifier;

a second capacitor; and a sixth resistor, connected to the second capacitor in series and both connected to the fifth resistor in parallel.

8. A light source driving device, connected to a DC power source, for converting a DC signal provided by the DC power source to an electrical signal to drive a plurality of light sources, wherein the DC power source has a high voltage end and a low voltage end, the light source driving device comprising:

an inverter circuit, connected between the high voltage end and the low voltage end of the DC power source, for converting the DC signal to the electrical signal adapted for driving the light sources;

a current sampling circuit, connected between the inverter circuit and the low voltage end of the DC power source, for sampling current flowing through the inverter circuit and generating an output signal, comprising:

an impedance detecting component, for detecting current from the inverter circuit;

an amplifying circuit, connected to the impedance detecting component for amplifying the current signal, comprising:

an amplifier, including a positive electrode input, a negative electrode input and an output;

a first impedance component, one end of thereof being connected to the negative electrode input of the amplifier, and the other end thereof being connected to one end of the impedance detecting component;

a second impedance component, connected between the negative electrode input and the output of the amplifier and a first filter circuit connected between the positive electrode input of the amplifier and the other end of the impedance detecting component, comprising:

a first resistor, one end thereof being connected to the other end of the impedance detecting component a first capacitor, connected between the positive electrode input of the amplifier and ground; and a second resistor, connected to the first capacitor in parallel; and a PWM controller, connected between the current sampling circuit and the inverter circuit, for receiving the amplified current signal output from the current sampling circuit, and generating a control signal to the inverter circuit to control output thereof 9. The light source driving device of claim 8, further comprises a second filter circuit connected between the high voltage end and the low voltage end of the DC power source.

10. The light source driving device of claim 8, wherein the current sampling circuit comprising:

a fourth resistor;

a switch component comprising an input, a first output and a second output, wherein the input is controlled by a PWM signal, the first output is connected to the PWM controller by way of the fourth resistor, the second output is grounded.

11. The light source driving device of claim 10, wherein the second impedance component comprising:

a fifth resistor, disposed between the negative electrode input and output of the amplifier;

a second capacitor; and a sixth resistor, connected to the second capacitor in series and connected to the fifth resistor in parallel.

12. The light source driving device of claim 8, wherein the second filter circuit is disposed between the high voltage end of the DC power source and the input of the impedance detecting component.

13. The light source driving device of claim 8, wherein the second filter circuit is disposed between the high voltage end of the DC power source and the output of the impedance detecting component.

14. A light source driving device, connected to a DC power source, for converting a DC signal provided by the DC power source to an electrical signal to drive a plurality of light sources, wherein the DC power source has a high voltage end and a low voltage end, the light source driving device comprising:

an inverter circuit, connected between the high voltage end and the low voltage end of the DC power source, for converting the DC signal to the electrical signal adapted for driving the light sources;

a current sampling circuit, connected between the inverter circuit and the low voltage end of the DC power source, for sampling current flowing through the inverter circuit and generating an output signal, comprising:

a fourth resistor;

a switch component comprising an input, a first output and a second output, wherein the input is controlled by a PWM signal, the first output is connected to the PWM controller by way of the fourth resistor, the second output is grounded; and a PWM controller, connected between the current sampling circuit and the inverter circuit, for receiving the amplified current signal output from the current sampling circuit, and generating a control signal to the inverter circuit to control output thereof.

15. The light source driving device of claim 14, wherein the current sampling circuit comprises:

an impedance detecting component, for detecting current from the inverter circuit; and an amplifying circuit, connected to the impedance detecting component for amplifying the current signal.

16. The light source driving device of claim 15, wherein the amplifying circuit comprises:

an amplifier, including a positive electrode input, a negative electrode input and an output;

a first impedance component, one end of thereof being connected to the negative electrode input of the amplifier, and the other end thereof being connected to one end of the impedance detecting component; and a second impedance component, connected between the negative electrode input and the output of the amplifier.

17. The light source driving device of claim 16, wherein the second filter circuit is disposed between the high voltage end of the DC power source and the input of the impedance detecting component.

18. The light source driving device of claim 16, wherein the second filter circuit is disposed between the high voltage end of the DC power source and the output of the impedance detecting component.

19. The light source driving device of claim 14, wherein the current sampling circuit comprises a first filter circuit connected between the positive electrode input of the amplifier and the other end of the impedance detecting component.

20. The light source driving device of claim 19, wherein the first filter circuit comprising:

a first resistor, one end thereof being connected to the other end of the impedance detecting component;

a first capacitor, connected between the positive electrode input of the amplifier and ground; and a second resistor, connected to the first capacitor in parallel.

21. The light source driving device of claim 14, wherein the second impedance component comprising:

a fifth resistor, disposed between the negative electrode input and output of the amplifier;

a second capacitor; and a sixth resistor, connected to the second capacitor in series and connected to the fifth resistor in parallel.

22. The light source driving device of claim 14, further comprises a second filter circuit connected between the high voltage end and the low voltage end of the DC power source.

* * * * *